United States Patent [19]

Murmann et al.

[11] Patent Number: 4,467,160

[45] Date of Patent: Aug. 21, 1984

[54] LOW PROFILE SWITCH

[75] Inventors: Gunter Murmann, Pegnitz; Günter Bauer, Sulzbach-Rosenberg, both of Fed. Rep. of Germany

[73] Assignee: Cherry Electrical Products Corporation, Waukegan, Ill.

[21] Appl. No.: 512,927

[22] Filed: Jul. 12, 1983

[30] Foreign Application Priority Data

Aug. 6, 1982 [DE] Fed. Rep. of Germany ..... 3229465

[51] Int. Cl.[3] ..... H01H 13/52; H01H 3/12

[52] U.S. Cl. ..... 200/159 A; 200/153 V

[58] Field of Search ..... 200/159 A, 159 R, 5 A, 200/153 V

[56] References Cited

U.S. PATENT DOCUMENTS

| | | | |
|---|---|---|---|
| 3,255,333 | 6/1966 | Schuchard | 200/159 R |
| 3,392,250 | 7/1968 | Ziegler et al. | 200/159 A |
| 3,715,545 | 2/1973 | Long | 200/159 A |
| 3,735,058 | 5/1973 | Berry | 200/159 R |
| 3,773,997 | 11/1973 | Evans et al. | 200/153 V |
| 3,777,090 | 12/1973 | Muller | 200/153 V |
| 3,940,578 | 2/1976 | Pointon | 200/340 |
| 3,993,884 | 11/1976 | Kondur et al. | 200/340 |
| 4,150,272 | 4/1979 | Bruun et al. | 200/159 A |
| 4,361,743 | 11/1982 | Ayers | 200/159 A |

*Primary Examiner*—John W. Shepperd

*Attorney, Agent, or Firm*—Willian Brinks Olds Hofer Gilson & Lione

[57] ABSTRACT

A low profile switch key has a base which slidingly supports a pushbutton. The pushbutton is slidingly engaged with a plunger body by a lost motion connection. The plunger body carries cams which control the flexing of contactors to make and break conductive connections with adjacent stationary contacts. A coil spring biases the pushbutton upwardly to its rest position. The sliding lost motion between the pushbutton and plunger body allows the pushbutton to slide by itself over an initial pretravel interval when it is pressed. At the end of the pretravel interval, the pushbutton strikes the plunger body and carries the body downward to complete the key stroke. The plunger body resists sliding movement and therefore provides a perceptible pressure point which indicates actuation of the switch. The stationary contacts and associated overlying cams are interlocked when the pushbutton is depressed to provide a relatively low switch profile with respect to the length of the key stroke.

24 Claims, 5 Drawing Figures

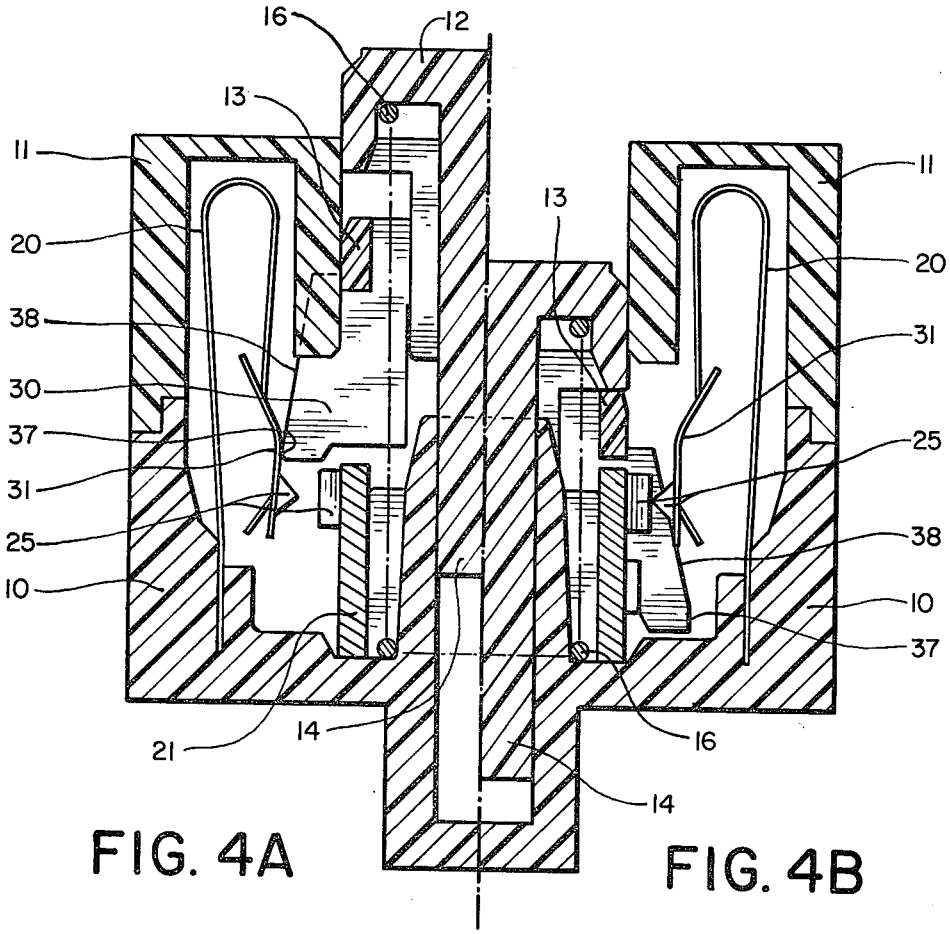
FIG. 4A
FIG. 4B
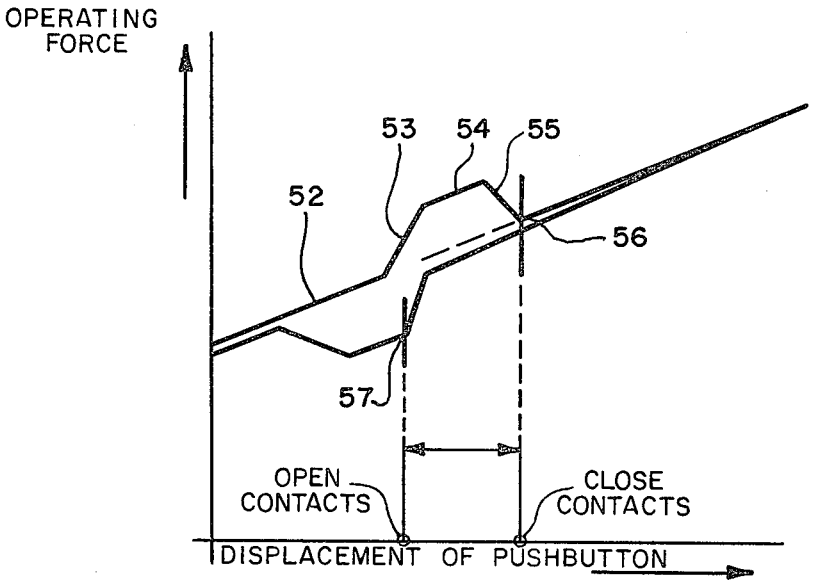
FIG. 5

LOW PROFILE SWITCH

TECHNICAL FIELD

The invention relates to an electrical switch with a relatively low profile and, more particularly, to such a switch which provides a positive tactile feel when contacts of the switch are closed.

BACKGROUND OF THE INVENTION

High speed electric typewriters and data input keyboards for computer systems require switch keys which operate reliably over a relatively long service life and which also provide a desirable tactile feel when they are pressed. In modern keyboards, the profile of the switches must be sufficiently low to provide a maximum height of about 30 millimeters for key switches in the third row of the keyboard. Moreover, in view of the large number of keys required for keyboards, keys must be relatively easy to assemble and should preferably be structured to allow rapid automatic assembly.

Low profile keys must also provide a relatively long key stroke of, for example, 4 millimeters. Each key should preferably operate with hysteresis to provide a slightly delayed actuation of switch contacts over the pressing key stroke and a corresponding delayed opening of the contacts when the key is released. This hysteresis behavior is required from a human engineering standpoint to avoid inadvertent operations and multiple operations of the switch when it is pressed and then released.

It is therefore an object of the invention to provide a relatively low profile switch which avoids inadvertent operations and multiple operations of switch contacts.

A further object of the invention is to provide such a low profile switch with contacts which are opened and closed with a hysteresis operation.

Another object of the invention is to provide a switch with a relatively low profile in relation to its key stroke.

A further object of the invention is to provide a low profile switch which is reliable in operation over a relatively long life and which may be easily and automatically assembled.

Another object of the invention is to provide a key switch which requires a perceptible increase in operative pressure to close its contacts.

SUMMARY OF THE INVENTION

In order to achieve the objects of the invention and to overcome the problems of the prior art, the low profile switch of the invention employs a pushbutton which is reciprocated within a switch housing to flex switch contactors into and out of conductive contact with associated stationary contacts.

The pushbutton is slidingly engaged in a lost motion fashion with a plunger body. The plunger body is also slidingly supported for reciprocating motion within the housing of the switch. A coil spring is provided to bias the pushbutton, and hence the plunger body, upwardly with respect to the housing. The plunger body carries transversely extending switch actuating cams which slidingly engage the contactors.

In the rest position of the switch, the coil spring holds the pushbutton and plunger body at their top positions within the housing and the switch actuating cams hold the contactors out of electrical contact with their associated stationary contacts.

When the pushbutton is initially pressed, it moves downwardly by itself over a pretravel distance defined by its lost motion connection with the plunger body. The pushbutton thus moves by itself against the bias force of the coil spring.

When the pushbutton reaches the end of its pretravel, it strikes the plunger body and thus begins to apply pressure to the body to cause it to slide downwardly. The frictional engagement between the plunger cams and their flexible contactors resists downward movement, so that an increased pressing force is required to move the pushbutton and plunger body down. The increased force required for downward movement provides a perceptible tactile feel which indicates the imminent activation of the switch. As the pushbutton and plunger body move downward, the cams of the plunger body gradually release their flexible contactors until, near the bottom of the key stroke, the contactors touch their associated stationary contacts.

When the pushbutton is released, the coil spring initially lifts up the pushbutton over the lost motion distance until it again engages the plunger body and lifts it upwardly. The cams of the plunger then press the flexible contactors away from their associated stationary contacts.

The lost motion operation for release of the pushbutton ensures that the closed contacts will not be opened until the pushbutton has moved at least a predefined lost motion distance.

In an embodiment of the invention, the lost motion connection between the pushbutton and plunger body is provided by hook-shaped arms on the pushbutton which engage corresponding shoulders formed within guide grooves of the plunger body. The guide grooves ensure that the hook arms will reciprocate evenly within the plunger body. Thus, an off-center actuation of the pushbutton will not cause the pushbutton to move transversely, bind with the plunger body and prematurely move the body to its switch actuating position.

The pushbutton has an axially extending stem which engages an upstanding sleeve of the housing to further align the pushbutton and plunger body for smooth reciprocating movement within the housing. One end of the coil spring is disposed over the guide sleeve of the housing and the other end is disposed over the stem between the lost motion arms of the pushbutton to ensure that the spring applies its restoring force only to the pushbutton. Thus, the plunger body can move only through its lost motion connection with the pushbutton.

The resistance of the plunger body to sliding movement may be increased by providing resilient leaf springs on the plunger body to press against the housing. The increased resistance will provide a greater tactile feel to indicate actuation of the switch.

The profile of the key may be minimized with respect to the key stroke of the key by forming mating slots in cams and underlying stationary contacts of the plunger body. The slots allow additional noninterfering reciprocating movement between the cams and the contacts.

Rotary movement of the plunger body with respect to the housing is prevented by engaging projections of the plunger body within guide slots formed in the housing. The guide slots also allow easy assembly of the switch, because the plunger body may be easily keyed into the slots when the switch is assembled.

The housing of the switch includes a cover with an aperture through which the pushbutton extends. The aperture of the cover has side walls which slidingly engage the plunger body and support the body for smooth sliding motion within the housing.

BRIEF DESCRIPTION OF THE DRAWINGS

FIG. 4A illustrates a sectional side elevation view of the assembled switch of FIG. 1 with the pushbutton at its top rest position.

FIG. 4B illustrates a sectional side elevation view of the switch of FIG. 1 with the pushbutton disposed at its fully pressed position.

FIG. 5 shows a graph of operating force on the pushbutton in relation to displacement of the pushbutton and associated plunger body within the switch of FIG. 1.

DETAILED DESCRIPTION OF PREFERRED EMBODIMENT

Figure 1:
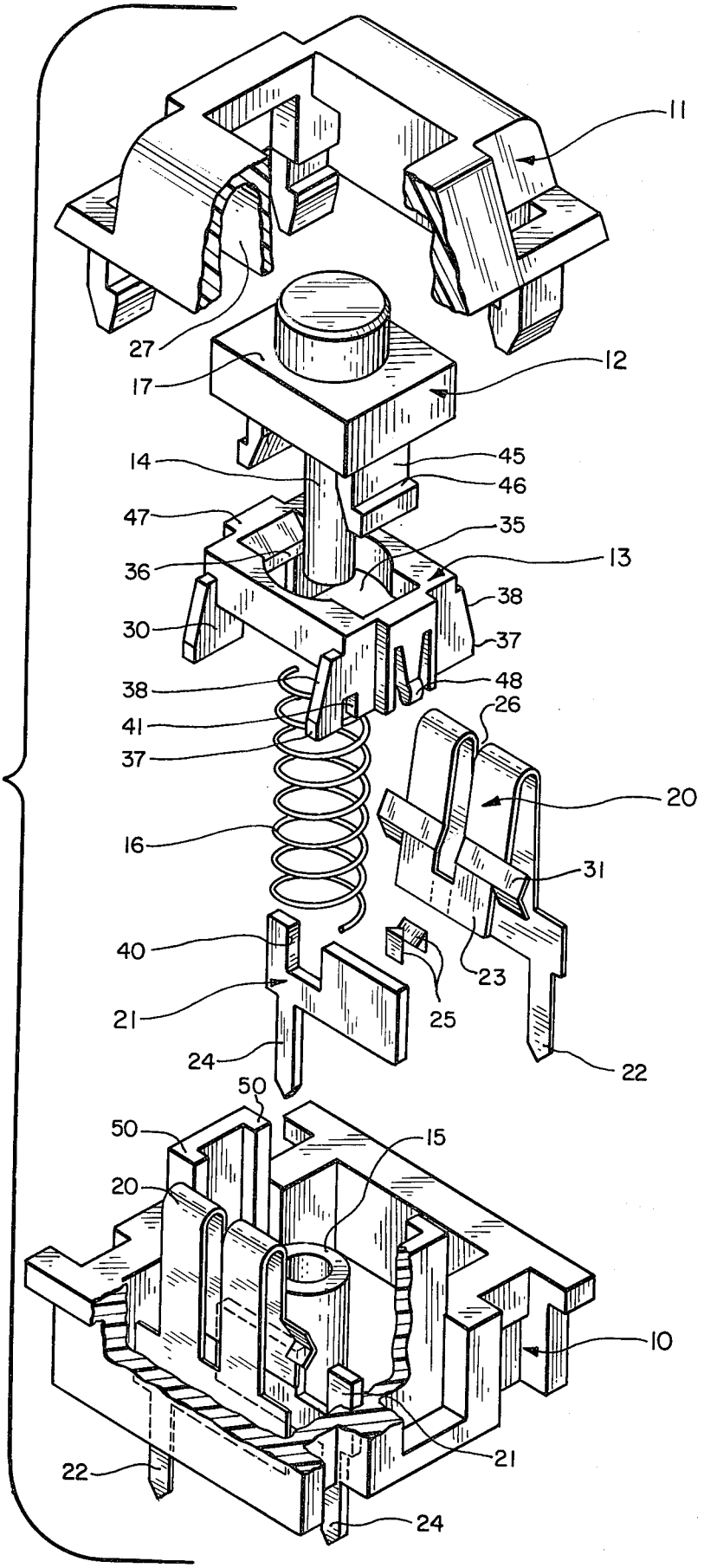
FIG. 1 illustrates an exploded view in partial section of a low profile switch in accordance with the invention.

The following portion of the specification describes a preferred embodiment of the invention when read in conjunction with the attached drawings, in which like reference characters designate identical apparatus.

FIG. 1 illustrates an exploded view of an embodiment of the key switch of the invention. As shown in FIG. 1, a base 10 supports a pushbutton 12 and an associated plunger body 13 for reciprocating movement with respect to the base. In assembling the switch of FIG. 1, the pushbutton 12 is passed through a central bore 35 of the plunger body until hook arms 45 snap into engagement with shoulders formed within grooves 36 of the plunger body. A coil spring 16 is engaged around a stem 14 of the pushbutton and the assembled pushbutton 12, plunger body 13 and coil spring 16 are then mounted within the base 10 so that the stem 14 extends into an upstanding sleeve 15 and the spring 16 is engaged over the sleeve. The spring presses against the underside of a cap portion 17 of the pushbutton to bias the pushbutton upwardly.

An electrically conducting stationary contact 21 is fitted within the base 10, as shown in the cutaway section of FIG. 1. An associated electrically conducting contactor 20 is also engaged with the base and is oriented so that a conducting contact 25 of its contact face 23 is opposed to a conducting contact 25 of the stationary contact 21.

The base 10 may carry one or two of the contactors 20, depending upon the desired switching characteristics for the switch of FIG. 1. In order to facilitate an understanding of the invention, one of the contactors 20 is shown in engaged relation with the base 10 and the other is shown in exploded relation to the base to better illustrate its structure. The flexible contact faces 23 of the contactors 20 are transversely flexed into and out of contact with their associated opposite stationary contact elements 21. The contactors 20 and stationary contacts 21 have respective leads 22 and 24 which extend through openings in the base 10 to conductively connect the switch to an associated circuit (not shown), for example by soldering. Each of the contactors 20 is positioned so that the contact 25 carried on its face 23 is spaced from an opposite contact 25 of a stationary contact element 21 when the pushbutton 12 is in its released or rest position.

When the above-described components are assembled within the base 10, a cover 11 is pressed into snapping engagement with the base, so that the cap 17 of the pushbutton extends through a central aperture of the cover and side walls of the plunger body 13 slidingly engage the walls of the cover.

The top portion of each of the U-shaped contactors 20 extends into an associated recess 27 formed in the cover 11. Each recess 27 is dimensioned so that the legs of its contactor 20 can be varied in length without changing the position of the contact plane. With this structure, contactors may extend fully into the recesses and thereby provide a relatively long contact spring of reduced rigidity.

The contact face 23 of each contactor 20 has a V-shaped cam surface 31. In operation, the cam surface 31 is engaged by an associated key cam 30 formed on the plunger body 13. When the plunger 13 reciprocates in the housing, each key cam 30 engages its opposite contactor cam surface 31 and thus flexes the contactor to make and break conductive contact with an associated stationary contact 21.

Selected cams 30 have slots 41 formed therein to engage corresponding underlying slots 40 of associated stationary contacts 21. The slots are provided so that the plunger body 13 can move down to the bottom of the base 10 to provide a relatively long key stroke without being blocked by the contacts 21. The switch thus has a relatively low profile in relation to the length of its key stroke.

Figure 2:
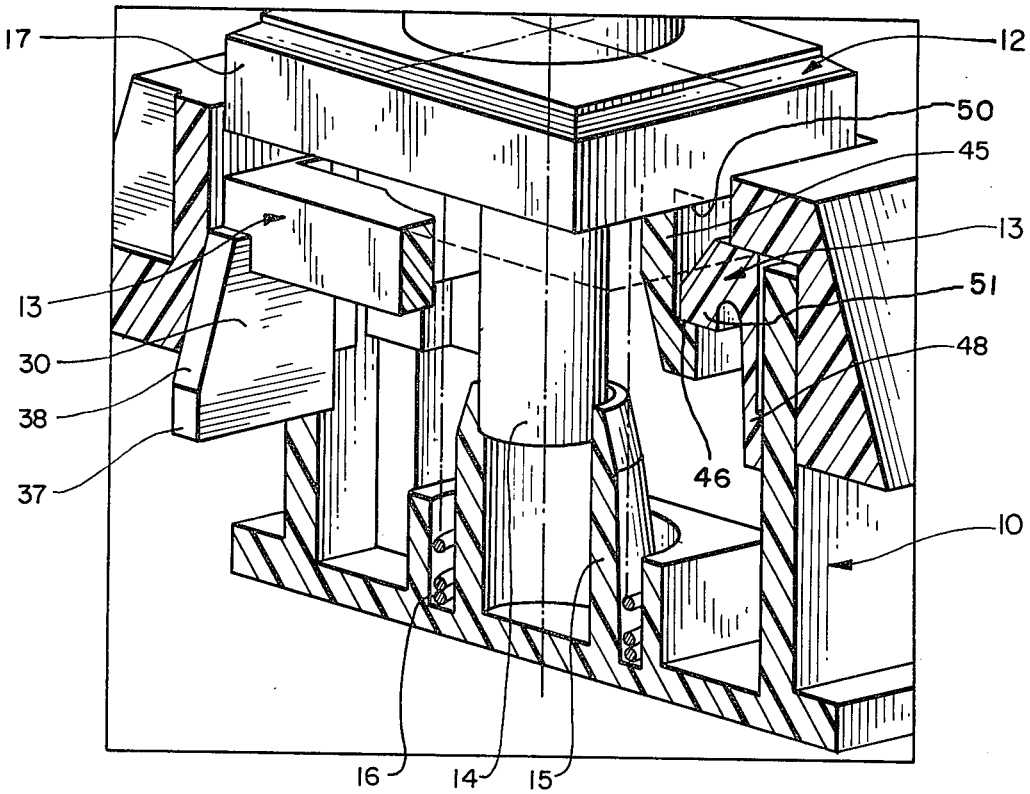
FIG. 2 illustrates a perspective view in partial section of a pushbutton, plunger body and housing of the switch of FIG. 1.

FIG. 2 illustrates a perspective view in partial section of the base 10, pushbutton 12 and plunger body 13 disposed in the rest state with the coil spring 16 biasing the pushbutton and plunger body upwardly. As shown in FIG. 2, the hook-shaped arms 45 extend downwardly within the grooves 36 of the plunger body 13 and form lower stop shoulders 46 and upper stop shoulders 50 at the underside of the cap 17. The arms 45 lie on opposite sides of the stem 14 of the pushbutton plunger 12 and are positioned on opposite sides of the coil spring 16 positioned over the stem 14. As shown in FIG. 2, when the pushbutton 12 is biased upwardly to its rest position, the stop shoulders 46 of the hook arms 45 abut shoulders of lost motion projections 51 of the plunger body 13.

In assembling the switch, the hook arms 45 are sufficiently resilient so that, when the pushbutton 12 is inserted in the plunger body 13, the arms are initially pressed inwardly and then snap outwardly to engage the lost motion projections of the plunger body. The lost motion area for this connection is defined between the upper 50 and lower 46 stop shoulders of the arms 45. The coupled pushbutton and plunger can therefore slide with respect to one another over a lost motion distance defined by the movement of the lost motion projections 51 of the body 13 within the area between respective upper and lower stop shoulders.

As shown in FIG. 1, the plunger body 13 has projections 47 formed at its ends to slidingly engage corresponding grooves formed in the body 10 by upstanding guide rails 50. The grooves of the guide rails 50 and associated projections 47 are provided to orient the plunger body 13 for sliding reciprocating motion within the base 10. The plunger body 13 thus cannot rotate or tilt within the base 10 and will therefore smoothly slide within the base in response to off-axis pressing of the pushbutton 12.

Each of the projections 47 hs an integral resilient spring 48 made of, for example plastic, which presses outwardly against an inner wall of the base 10. The springs 48 resist the axial sliding movement of the plunger body 13 within the base.

The guide rails 50 extend beyond the upper edge of the base 10 in order to facilitate assembly of the switch particularly when the switch is automatically assembled. In manufacturing, the plunger body 13 may be easily oriented and engaged within the base 10 by aligning the projections 47 with their associated grooves between the rails 50 and then pressing the body 13 within the base. The arms 45 of the pushbutton 12 engage grooves 36 in the plunger body 13. These groove keying structures allow easy assembly with minimal requirements for aligning components.

Figures 3A, 3B, 3C:
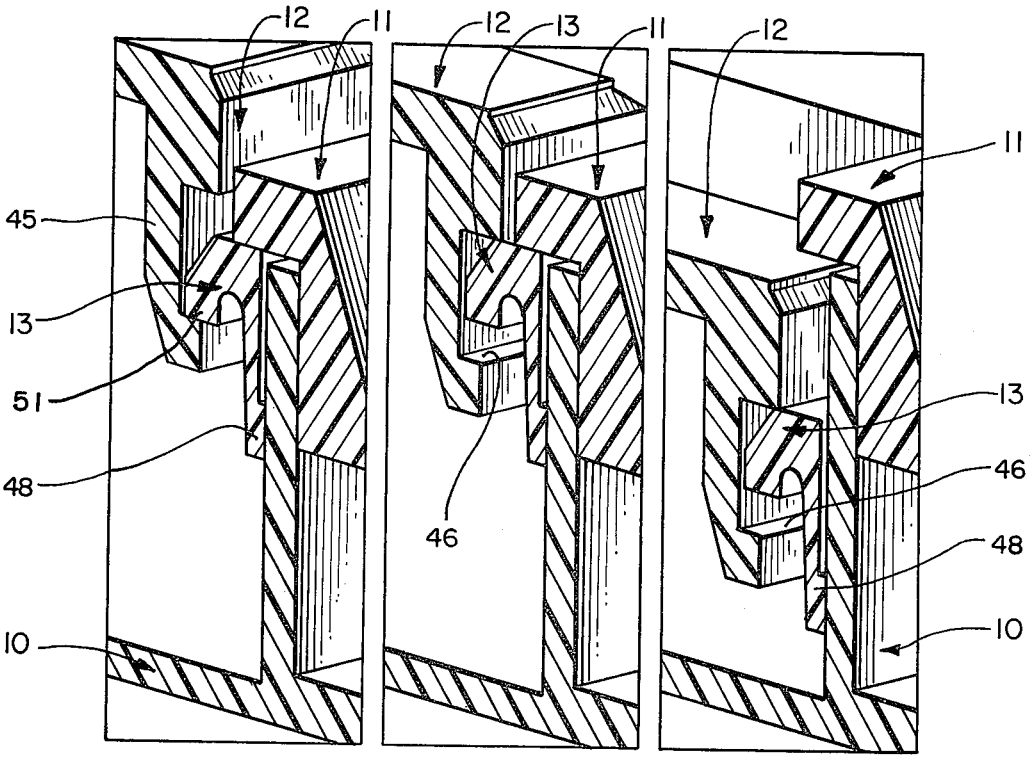
FIGS. 3A-3C illustrate the relative positioning of components of the low profile switch of FIG. 1 when the pushbutton is pressed downwardly.

FIGS. 3A–3C and FIGS. 4A and 4B illustrate the orientation of components of the switch in response to pressing and release of the pushbutton 12. FIG. 3A illustrates a partial cross-section of the lost motion connection between the pushbutton 12, cover 11, base 10 and plunger body 13 when the pushbutton is at its rest position. As indicated above, in this position the lower shoulders 46 of the hook arms 45 abut an opposite shoulder of a projection 51 formed in the plunger body 13.

FIG. 4A illustrates a cross-sectional view of the assembled switch components when the pushbutton 12 is in the position shown at FIG. 3A. As shown in FIG. 4A, when the pushbutton 12 is biased upwardly by the coil spring 16, a vertical surface 37 of the cam 30 presses against the contactor cam surface 31 and thereby presses the contact element 25 of the contactor 20 away from the contact 25 of the stationary contact 21.

FIG. 5 illustrates a graph of the operating force of the pushbutton 12 in relation to the displacement of the pushbutton and plunger body 13. At the position illustrated in FIGS. 3A and 4A, no force is applied to the pushbutton 12 and the switch is therefore at rest.

As shown at FIG. 3B, when linearly increasing pressure is applied to the pushbutton, the pushbutton moves downwardly against the linearly increasing force of the spring 16. The portion 52 of the graph of FIG. 5 shows the linearly increasing force that is initially required to overcome the pressure of the spring and to thereby move the pushbutton downwardly. During this initial pressing of the pushbutton, the plunger body is not moved downwardly, because the lost motion connection between the pushbutton and plunger body initially allows the pushbutton to slide with respect to the body.

When the underside of the cap 17 of the pushbutton contacts the top surface of the projections 51 of the plunger body, the body resists downward movement of the pushbutton. The resistance is provided in part by the frictional engagement of the cams 30 with their associated contact cam surfaces 31. Additional resistance is provided by the outward pressure of the springs 48 against adjacent walls of the base 10. A sharply increasing force shown at 53 is therefore required to overcome the resistance of the plunger body to downward movement.

As shown at 54, when the force on the pushbutton increases sufficiently to overcome the resistance of the plunger body, the pushbutton and body begin to move downwardly as a unit in response to a linearly increasing force which causes the contactor cam surface 31 to slide over the vertical portions 37 of the cams 30. As shown at 55, when the cam surfaces 31 move from the vertical sections 37 to the inclined sections 38 of the cams 30, the actuating force required to move the pushbutton and plunger body is rapidly reduced. As the pushbutton and plunger body continue to move downwardly, the cam surfaces 31 slide along the moving surfaces 38 of the cams 30. The surfaces 38 gradually allow the contacts 25 of the contact faces 23 of the contactors 20 to move toward the contacts 25 of their associated stationary contacts 21.

As shown in FIGS. 4B and 5, the pushbutton and plunger body continue to move downwardly until the contacts 25 of the contactors 20 and stationary contacts 21 close at a switching point 56. The key stroke may continue after the switching point to provide an overtravel feel for the switch. During this overtravel movement a linearly increasing pressure is required to further compress the coil spring 16.

The hysteresis switching operation illustrated in FIG. 5 provides a desirable pretravel for the pushbutton, a tactile pressure point to indicate actuation of the switch, and an overtravel after contacts of the switch have closed. The hysteresis operation further ensures that a perceptible downward force must be applied to the pushbutton before the switch contacts are closed. This operation ensures that the pushbutton switch will not be inadvertently actuated.

When the pushbutton is released, the spring 16 forces the pushbutton upward by itself over its lost motion distance. When the lower shoulders 46 of the arms 45 contact the lost motion projections 51 of the plunger body, the body moves upward with the pushbutton. As the pushbutton and plunger body moves upwardly, the cam surfaces 31 slide along the inclined surfaces 38 of their respective cams 30 and, at a predefined point 57, contacts 25 of the respective contactors and stationary contacts 21 are separated. Releasing the pushbutton will thus cause the pushbutton actuating force to linearly decrease until the open-contact point is reached. The cam surfaces 31 will continue to slide along the cam faces 38 and 37 until the pushbutton returns to its rest state, illustrated in FIGS. 2, 3A and 4A.

The hysteresis operation for the release of the pushbutton causes the contacts of the switch to open at a time different from the time at which the contacts are closed. Thus, inadvertent opening of the contacts around the point of closure is avoided.

In the switch of FIG. 1, two contactors 20 are mounted in the base 10 and are each operated by two associated adjacent cams 30 of the plunger body 13. It should be understood that the invention is not limited to the use of two contactors. Thus, one contactor could be employed without departing from the invention. If one contactor is employed, its frictional engagement with the cam surfaces of the cams 30 on one side of the plunger body 13 will not interfere with the proper sliding of the body or of the pushbutton, because the body is slidingly engaged in the grooves formed by the rails 50 and the pushbutton 12 is slidingly engaged within grooves 36 of the body 13. Thus, the asymmetrical pressure from one contactor 20 cannot twist or tilt the sliding components.

As shown in FIG. 1, each contactor 20 has a slit 26 which separates portions of the contact face 23. The slit 26 could be extended to separate the contact face 23 into two independently flexible portions which are electrically connected by the body of the contactor. A separate contact 25 could then be placed on each of the independently flexible contact faces. The faces would then operate with associated cams 30 of the plunger body 13 to provide a redundant switching operation with respect to adjacent stationary contacts 21. The redundant switching operation would ensure that a good electrical contact is made, even if one of the contacts 25 of the contactors 20 or stationary contacts 21 has a reduced conductivity as a result of dust or other interfering insulating debris.

The tactile pressure point provided to signal the switching operation of the key can be increased by changing the shape of the vertical section 37 of the cams 30. Thus, for example, the face 37 could be shaped to provide a projection in the area of transition from the section 37 to the inclined section 38. The vertical section 37 could therefore be shaped to rise outwardly at its point of transition with the inclined section 38 and to taper inwardly toward the base of the cam 30. It should be understood that other shapes for the vertical cam section 37 and inclined cam section 38 can be provided to control the flexing of the contact face 23 of the contactor 20, without departing from the spirit of the invention.

Accordingly, the invention may be embodied in other specific forms without departing from its spirit or essential characteristics. The present embodiments are, therefore, to be considered in all respects as illustrative and not restrictive. The scope of the invention is therefore indicated by the claims rather than by the foregoing description. All changes which come within the meaning and range of the equivalents of the claims are intended to be embraced therein.

We claim:

1. A switch, comprising:

housing means;

pushbutton means for slidingly reciprocating over a predefined keystroke distance in said housing means in response to the application and release of an operating force;

plunger body means having means for slidingly coupling to said pushbutton means so that the pushbutton means moves by itself over a predefined lost motion portion of said key stroke distance and carries said plunger body over the remaining portion of the key stroke distance;

spring means carried by said plunger body means for pressing against said housing means and resisting sliding movement of said plunger body means to provide a perceptible increase in operating force for moving the pushbutton means when the pushbutton means begins to carry the plunger body means;

at least one stationary electrically conducting contact means; and at least one electrically conducting movable contactor means for flexing to make and break conductive contact with the stationary contact means;

said plunger body means including at least one cam means for holding said contactor means in spaced relation to said stationary contact means when no force is applied to the pushbutton and when the pushbutton moves over said lost motion portion, and allowing the contactor means to flex against the stationary contact means at a predefined activation point after the lost motion portion of the key stroke.

2. The switch of claim 1, further including a spring for biasing said pushbutton means in a predefined direction.

3. The switch of claim 1, wherein said pushbutton means includes a stem portion and said housing includes a sleeve for slidingly engaging the stem portion to support the pushbutton means for reciprocating movement.

4. The switch of claim 1, wherein said cam means includes a first cam surface for holding said contactor means in spaced relation to said stationary contact means and a second inclined cam surface for allowing the contactor means to flex against the stationary contact means.

5. The switch of claim 1, wherein said cam means includes a cam surface for frictionally engaging said contactor means to resist sliding movement of the plunger body means when the plunger body means is carried by the pushbutton means.

6. The switch of claim 1, wherein said stationary contact means includes at least one slot and said cam means includes at least one mating slot, said housing means supporting the stationary contact means below the cam means so that the slots engage when the plunger body means is carried downwardly by the pushbutton means, the engagement of the slots allowing the plunger body means to travel a portion of the key stroke distance without being blocked by said stationary contact means.

7. The switch of claim 1, wherein said contactor means includes a U-shaped electrically conducting terminal having a base end for engaging said housing means and having a flexible free end defining a switch contact face with a V-shaped cam portion for engaging said cam means.

8. The switch of claim 7, wherein said switch contact face includes two independently flexible portions for engaging said cam means to provide a redundant switching operation with said stationary contact means.

9. The switch of claim 1, wherein said pushbutton means includes a cap portion and at least two hook arms extending from the cap portion, each hook arm defining a lost motion slot with respect to the underside of the cap portion, and said plunger body means includes an aperture and guide slots for receiving said pushbutton means and shoulder means disposed in said guide slots for snappingly engaging the lost motion slots formed by said hook arms and cap, the shoulder means dimensioned to allow a predefined sliding lost motion movement between the pushbutton means and the plunger body means.

10. The switch of claim 1, wherein said plunger body means includes at least two projections and said housing means includes at least two grooves for receiving said projections to orient the plunger body means for sliding movement within the housing means.

11. A switch, comprising:

housing means;

pushbutton means for slidingly reciprocating over a predefined key stroke distance in said housing means in response to the application and release of an operating force;

spring means for biasing said pushbutton means in a predefined direction;

plunger body means having means for slidingly coupling to said pushbutton means so that the pushbutton means moves by itself over a predefined lost motion portion of said key stroke and carries said plunger body over the remaining portion of the key stroke;

stationary contact means disposed in said housing means for supporting at least one electrically conducting stationary contact;

contactor means disposed in said housing for supporting at least one electrically conducting movable contact and having means for flexing to make and break conductive contact between the movable contact and stationary contact; and spring means carried by said plunger body means for pressing against said housing means and resisting reciprocating movement of said plunger body means to provide a perceptible increase in operating force for moving the pushbutton means when the pushbutton means begins to carry the plunger body means;

said plunger body means including at least one cam means for flexing said contactor means to make and break conductive contact between the movable contact and stationary contact when the plunger body reciprocates in said housing wherein said cam means includes a cam surface for frictionally engaging said contactor means to resist sliding movement of the plunger body means when the plunger body means is carried by the pushbutton means.

12. The switch of claim 11, wherein said cam means includes a first cam surface for holding said contactor means in spaced relation to said stationary contact means when no force is applied to the pushbutton and when the pushbutton moves over said lost motion portion of the key stroke distance, and a second inclined cam surface for allowing the contactor means to flex against the stationary contact means at a predefined activation point after the lost motion portion of the key stroke.

13. The switch of claim 11, wherein said stationary contact means includes at least one slot and said cam means includes at least one mating slot, said housing means supporting the stationary contact means below the cam means so that the slots engage when the plunger body means is carried downwardly by the pushbutton means, the engagement of the slots allowing the plunger body means to travel a portion of the key stroke distance without being blocked by said stationary contact means.

14. The switch of claim 11, wherein said contactor means includes a U-shaped electrically conducting sheet having a base end for engaging said housing means and having a flexible free end defining a switch contact face with a V-shaped cam portion for engaging said cam means.

15. The switch of claim 11, wherein said pushbutton means includes a cap portion and at least two hook arms extending from the cap portion, each hook arm defining a lost motion slot with respect to the underside of the cap portion, and said plunger body means includes an aperture and guide slots for receiving said pushbutton means and shoulder means disposed in said guide slots for snappingly engaging the lost motion slots formed by said hook arms and cap, the shoulder means dimensioned to allow a predefined sliding lost motion movement between the pushbutton means and the plunger body means.

16. A switch, comprising:

a base;

a pushbutton for reciprocating with respect to the base;

a spring for biasing the pushbutton upwardly;

at least one stationary electrically conducting contact;

at least one electrically conducting contactor formed in a U-shape with a flexible free end having a contact face for flexing into and out of conductive contact with said stationary contact;

a plunger body and means for mounting the plunger body on said pushbutton for sliding movement between upper and lower end stop portions of the pushbutton;

said plunger body including at least one cam for moving said contact face into and out of conductive contact with said stationary contact; and means for resisting the sliding movement of said plunger body with respect to said base including at least one spring means carried by said plunger body for frictionally engaging said base, so that when the pushbutton is pressed down it initially slides down by itself until the plunger body stops at said upper end stop portion, the pushbutton thereafter carrying the plunger body down in response to an increased downward pressure to a point at which said cam moves to allow the contact face of the contactor to conductively contact said stationary contact.

17. The switch of claim 16, wherein said means for mounting includes at least two hook-shaped arms formed on said pushbutton, each arm having a first stop shoulder defining said upper end stop position and a second stop shoulder defining said lower end stop position; said plunger body including guide grooves for receiving said arms, each guide groove having a lost motion projection for moving between the first and second stop shoulders of said arms.

18. The switch of claim 17, wherein said pushbutton includes a stem portion positioned between the hook-shaped arms and said plunger body includes a central bore through which the stem portion extends, said base having an upstanding sleeve for receiving said stem for sliding movement with respect to the base.

19. The switch of claim 18, wherein said spring is disposed over said guide sleeve and said stem portion.

20. The switch of claim 16, wherein said means for resisting includes a surface of said at least one cam for pressing against said contactor to resist sliding movement of said plunger body.

21. The switch of claim 16, wherein said plunger body includes guide projections and said base includes guide ribs for forming guide grooves to slidingly receive said guide projections.

22. The switch of claim 21, including a cover for said base, said guide ribs extending from the base and into the cover.

23. The switch of claim 16, including a cover for said base, the cover having a central aperture and said pushbutton having a cap portion extending through and guided within said aperture.

24. A switch, comprising:

housing means;

pushbutton means for slidingly reciprocating over a predefined key stroke distance in said housing means in response to the application and release of an operating force;

biasing means for upwardly biasing said pushbutton means;

plunger body means for slidingly coupling to said pushbutton means so that when the pushbutton means is pressed downwardly it moves by itself over a predefined lost motion portion of said key stroke distance and carries said plunger body over the remaining key stroke distance, and when said pushbutton means is released it moves upwardly by itself over a predefined hysteresis portion of said key stroke distance and carries said plunger body upwardly over the remaining key stroke distance;

spring means carried by said plunger body means for pressing against said housing means and resisting sliding movement of said plunger body means to provide a perceptible increase in the operating force required to move the pushbutton means when the pushbutton means begins to carry the plunger body means;

at least one stationary electrically conducting contact means; and at least one electrically conducting movable contactor means for flexing to make and break conductive contact with the stationary contact means;

said plunger body means including at least one cam means for alternately flexing said contactor means into and out of conductive contact with said stationary contact means so that when no force is applied to the pushbutton means the cam means holds the contactor means in spaced relation to the stationary contact means, and when the pushbutton means is pressed downwardly the cam means holds the contactor means in spaced relation to the stationary contact means during the lost motion portion of the key stroke and allows the contactor means to flex into contact with the stationary contact means when the pushbutton means reaches a predefined switch activation position after the lost motion portion of the key stroke, and when the pushbutton means is released the cam means allows the contactor means to maintain contact with the stationary contact means during the hysteresis portion of the key stroke and flexes the contactor means to break contact with the stationary contact means when the pushbutton means reaches a predefined switch deactivation position after the hysteresis portion of the key stroke, said deactivation position being above said activation position.

* * * * *

UNITED STATES PATENT AND TRADEMARK OFFICE

CERTIFICATE OF CORRECTION

PATENT NO. : 4,467,160

DATED : August 21, 1984

INVENTOR(S) : Gunter Murmann and Günter Bauer

It is certified that error appears in the above-identified patent and that said Letters Patent is hereby corrected as shown below:

In the specification, column 5, line 3, delete "hs" and insert therefor --has--;

column 5, line 9, after "switch" insert --,--;

column 6, line 33, delete "moves" and insert therefor --move--.

In the claims, claim 1, line 4, delete "keystroke" and insert therefor --key stroke--.

Signed and Sealed this

Twenty-fifth Day of November, 1986

*Attest:*

DONALD J. QUIGG

*Attesting Officer* *Commissioner of Patents and Trademarks*